United States Patent [19]

Dougherty

[11] Patent Number: 5,035,194

[45] Date of Patent: Jul. 30, 1991

[54] FORCED FOIL SAIL

[76] Inventor: Patrick S. Dougherty, P.O. Box 798, Hood River, Oreg. 97031

[21] Appl. No.: 518,180

[22] Filed: May 3, 1990

[51] Int. Cl.[5] ..... B63H 9/08

[52] U.S. Cl. ..... 114/102; 114/39.2; 244/219

[58] Field of Search ..... 114/39.1, 39.2, 102, 114/103; 244/219

[56] References Cited

U.S. PATENT DOCUMENTS

| | | | |
|---|---|---|---|
| 3,332,383 | 7/1967 | Wright | 244/219 |
| 4,625,671 | 12/1986 | Nishimura | 114/103 |
| 4,699,073 | 10/1987 | Farneti | 114/39.2 |
| 4,856,447 | 8/1989 | Magnan | 114/103 |
| 4,924,794 | 5/1990 | Duke | 114/102 |
| 4,924,973 | 5/1990 | Pritchard | 114/102 |

FOREIGN PATENT DOCUMENTS

| | | | |
|---|---|---|---|
| 2119730 | 11/1983 | United Kingdom | 114/103 |
| 8707234 | 12/1987 | World Int. Prop. O. | 114/103 |

*Primary Examiner*—Sherman Basinger
*Assistant Examiner*—Thomas J. Brahan
*Attorney, Agent, or Firm*—Philip M. Shaw, Jr.

[57] ABSTRACT

A boardsailing sail camber inducer has a pair of springs coupling the camber inducer to the leading end of the batten to allow the forward end of the batten to rotate about the mast while simultaneously applying an aftward force along the longitudinal axis of the batten.

12 Claims, 3 Drawing Sheets

FORCED FOIL SAIL

TECHNICAL FIELD

This invention relates to a camber induced sail and more particularly to an improved camber inducer for forcing a sail to have a foil shape.

BACKGROUND ART

Contemporary camber induced sails, for example a boardsailing sail as shown in FIGS. 1, 2 and 3, consist of a sail 10 with a luff tube or sleeve 12 to accept a mast 14, battens 16 held in batten pockets 18 in the sail and a single or multiple camber inducers 20. A wishbone shaped boom 15 is rigidly (i.e. non-rotatably with respect to the mast 14) attached at one end to the mast 14 at a point partway up from the foot of the mast 14. The luff sleeve 12 has an opening in it to accommodate the attachment of the boom 15 to the mast 14. The sail 10 extends between the wishbone arms of the boom 15 towards its aft end where the sail 10 is pulled taut by an 20 outhaul line 19 attached between the clew of the sail and the aft end of the boom 15. The foot of the mast 14 is attached via a universal joint 7 to a sailboard 5.

A camber inducer is a coupling that connects a batten to the mast. When assembled, the sail takes the shape of an asymmetrical foil due to the force exerted on the camber inducer(s) by the batten(s) and due to the shape built into the sail by using broadseaming.

Such camber induced sails are described in U.S. Pat. Nos. 4,649,848 (Belvedere), 4,733,624 (Belvedere), 4,686,921 (Magnan), 4,708,079 (Magnan), 4,856,447 (Magnan), and 4,625,671 (Nishimura). These patents describe camber inducer devices whose primary purposes are to aerodynamically clean up the leading edge of the sail or do away with the turbulent wake found just behind the mast at the leading edge of the sail. Another important consideration of these patents is the rotational coupling of the leading ends of the battens to the mast to allow them to pivot with respect to the mast as the sail is rotated on the mast when changing tack. Although the boom 15 cannot rotate on the mast 14, the sail 10 does rotate about the mast 14 between the arms of the boom 15. Thus, on one tack the sail 10 assumes a concave foil shape as viewed in FIG. 3 but on another tack the sail 10 assumes a convex shape when viewed from the same side of the sailboard.

Still another consideration discussed in these patents is maintaining a high camber ratio with maximum draft of the sail positioned forwardly near the luff to contour the sail in an efficient aerodynamic shape irrespective of wind conditions. (See U.S. Pat. Nos. 4,625,671 and 4,686,921). Since these patents were issued, contemporary camber induced sails have evolved to the point where the sails are required to hold a rigid foil shape even during high wind conditions, i.e. when the sail is significantly loaded.

With such contemporary camber induced sails, however, when a high wind force loads the sail (FIGS. 2 and 3) the shapes of the overall foil and the leading edge are distorted and the tension is reduced. When a sail 10 is dynamically loaded, the high pressure builds on the windward side. This high pressure forces the flexible battens 16 in the sail 10 to bend and causes the center of force 22 acting on the sail 10 due to the wind, referred to as the "draft" of the sail, to move aft. Also, the force on the skin of the sail 10 locks the battens 16 in their pockets 18 in the aft section of the sail 10 and the result is that the battens are pulled away from the front of the sail. This does two things. It detensions the leading edge of the sail 10, i.e. slackens the sail in the fore and aft direction, and derotates the leading edge, i.e. flattens the degree of curvature, if not completely inverting it. This can be seen in both FIGS. 2 and 3. In FIG. 3 the effect is noticeable in the slight "S" shape imparted to the battens just aft of the luff sleeve 12.

Both of these effects reduce the aerodynamic efficiency of the sail. The detensioning also makes the sail 10 unstable and vulnerable to complete inversion in the event that the angle of attack to the wind is decreased. The altered foil shape develops less lift, has more drag and draft instability, and is very difficult to keep balanced and use in an effective sailing position.

One obvious solution to these problems is to use stiffer battens; however, this introduces additional problems. A boardsailing sail must be able to freely rotate about the mast during tacking. While the stiffer battens have proven to keep the draft from shifting, they do not overcome the problems of detensioning and derotation during loading. Furthermore, stiffer battens make rotation of the sail 10 about the mast during tacking more difficult.

DISCLOSURE OF INVENTION

It is, therefore, an object of the present invention to provide a camber induced sail which, when significantly loaded, will not detension at the leading edge.

It is another object of the present invention to provide a camber induced sail which, when significantly loaded, will not have an unstable draft.

It is yet another object of the present invention to provide a camber induced sail which, when significantly loaded, will not derotate at the leading edge.

It is a further object of the present invention to provide a camber induced sail which will not easily deform in shape when significantly loaded and which will easily rotate about the mast during tacking.

It is a still further object of the present invention to provide a camber induced sail which, when significantly loaded, will not lose its aerodynamic efficiency.

The above and other objects are achieved by the present invention of a camber inducer for a mast mounted sail having battens and which comprises a resilient coupling for pivotally connecting the forward end of the batten to the mast to allow the forward end of the batten to rotate about the mast while simultaneously applying an elastic aftward force along the longitudinal axis of the batten between the coupling and the forward end of the batten.

The camber inducer according to the present invention comprises a coupling having a yoke shaped portion for pivotally seating against the mast, a pair of spaced apart legs extending away from the yoke shaped portion, and an end wall which joins together the leg ends which are distal from the yoke shaped portion. The end wall has an aperture therein through which access can be had to the forward end of a batten. A hollow batten fitting has a batten end receiving recess therein. The batten fitting is resiliently and pivotally attached to the pair of legs by one or more elastic members such that the batten fitting is positioned between the pair of legs with the batten fitting recess being oriented with respect to the end wall aperture so that the forward end of a batten can enter the recess and be received in the batten fitting.

In the preferred embodiment, the batten fitting is mounted by means of a pair of tension springs, each pivotally mounted at a first end to a separate side of the batten fitting and at a second end to a separate, opposed edge of the end wall alongside the aperture. The batten fitting is rectangular in cross-section and is provided with a pair of posts extending from each of its narrower sides to which the first ends of the springs are separately, pivotally attached.

The sail in which the camber inducer is employed includes, in addition to the battens, separate restraining straps for applying an axially compressive force at the aftward end of each batten to force the batten toward the camber inducer and thereby cause the batten to bow to a desired degree. When a batten restraining strap applies an axial force to the aftward end of a batten, a substantially equal and opposite axial force is applied to the forward end of the batten by the springs acting through the batten fitting.

The foregoing and other objectives, features and advantages of the invention will be more readily understood upon consideration of the following detailed description of certain preferred embodiments of the invention, taken in conjunction with the accompanying drawings.

BEST MODE FOR CARRYING OUT THE INVENTION

Figure 1:
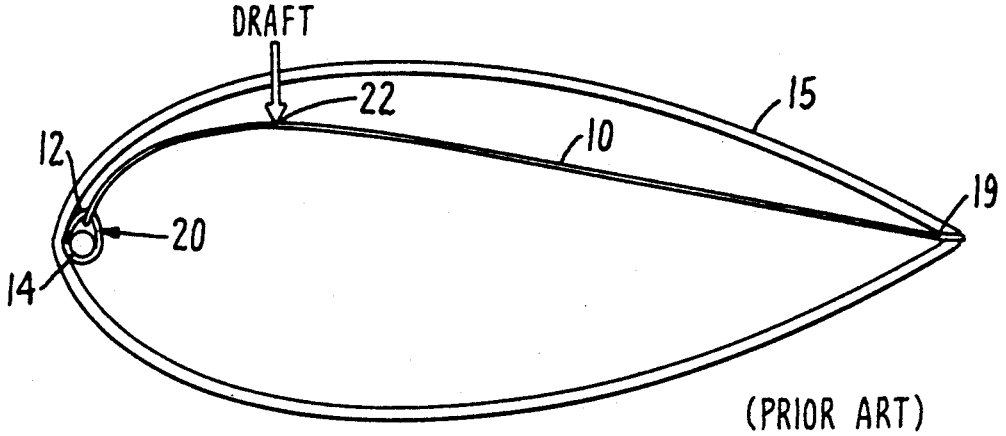
(PRIOR ART) FIG. 1.
FIG. 1 is a horizontal sectional view through an unloaded, prior art sail and mast taken generally along the line 1—1 in FIG. 3.
Figure 2:
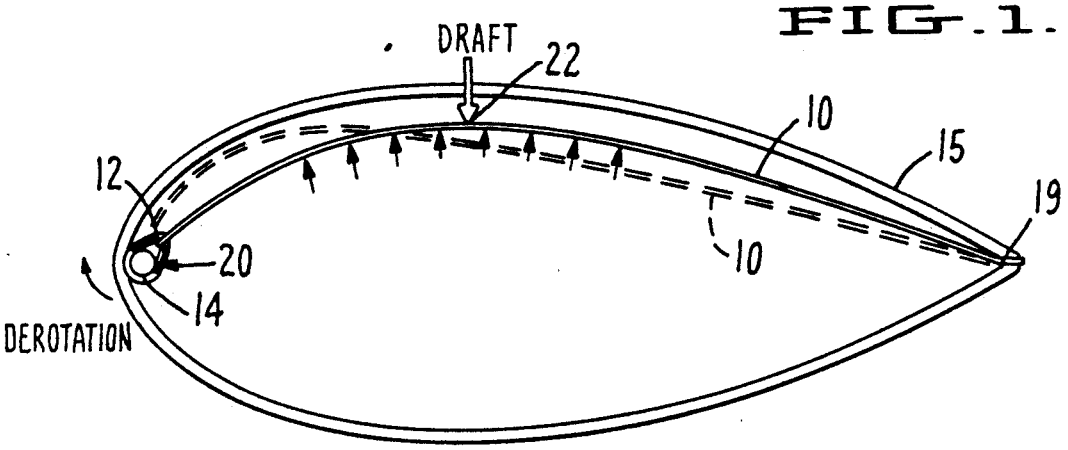
(PRIOR ART) FIG. 2.
FIG. 2 is the horizontal sectional view depicted in FIG. 1 when the sail is significantly loaded.
Figure 3:
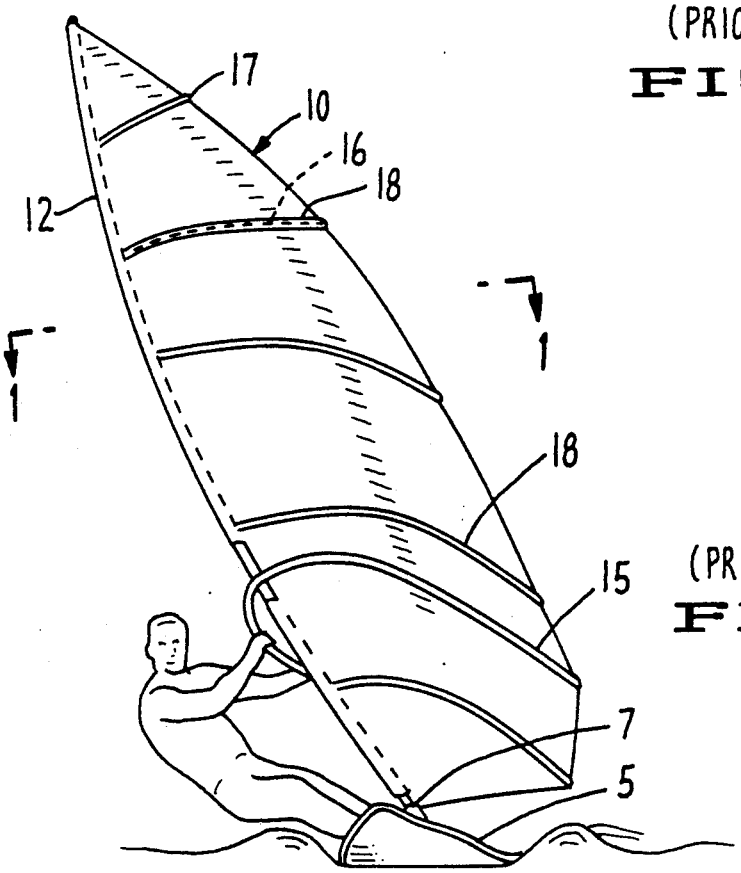
(PRIOR ART) FIG. 3.
FIG. 3 is a perspective view of a prior art sail, mast and sailboard.
Figure 4:
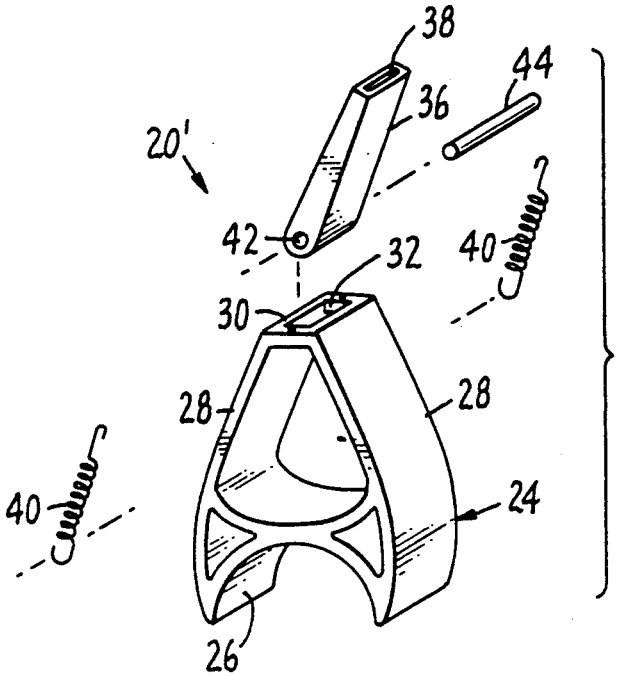
FIG. 4 is an enlarged, exploded, perspective view of a camber inducer according to the invention.
Figure 5:
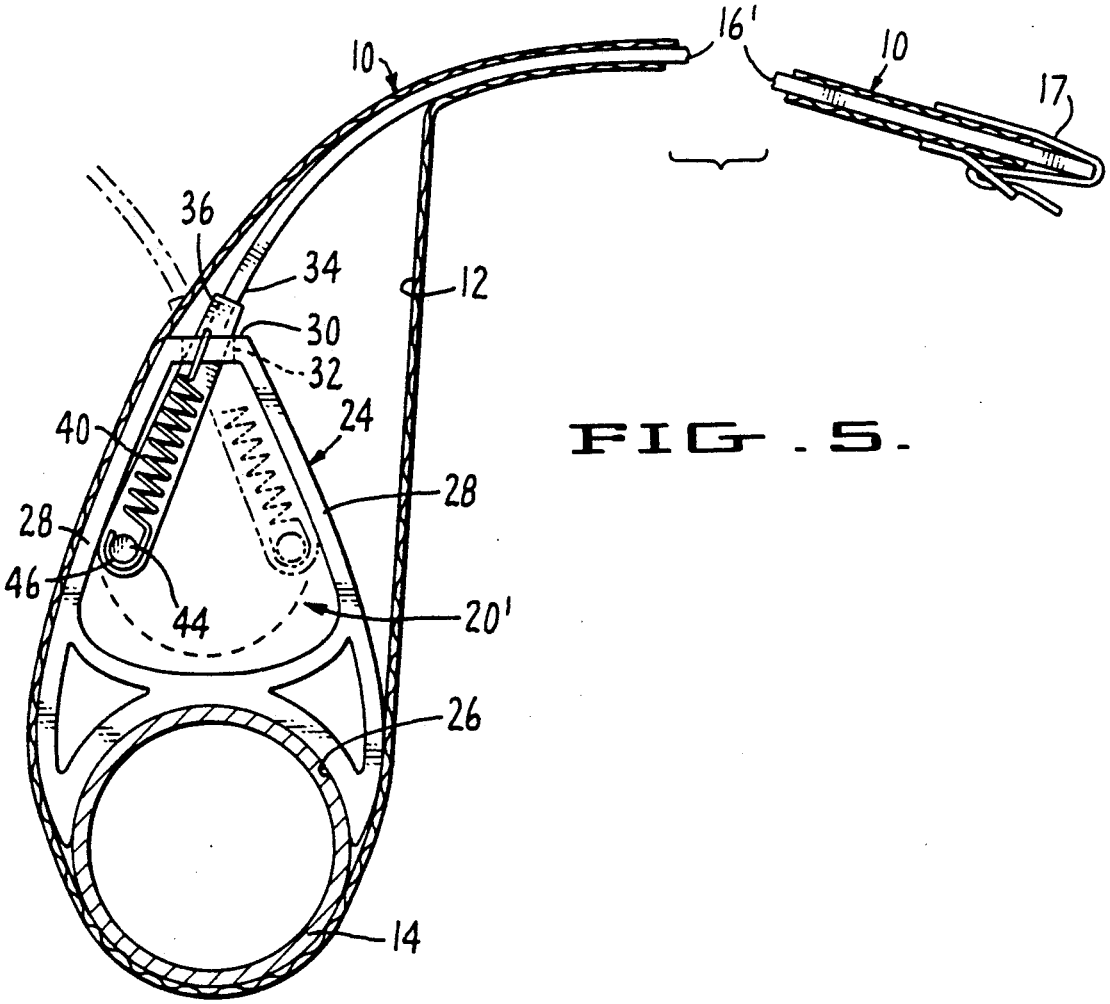
FIG. 5 is a horizontal, sectional view of a sail incorporating an assembled camber inducer according to the invention together with the leading and trailing end portions of the sail and a batten.

Referring now more particularly to FIGS. 4 and 5, the same reference numerals used in FIGS. 1, 2 and 3 are used in the following description for the same elements. The camber induced sail of the invention, like most contemporary camber induced sails, can have one or more battens 16' for stiffening the sail 10 to have a wing shape, a camber inducer 20' for pivotally coupling each batten 16' at one end to the mast 14, and a batten restraining strap 17 for applying an axially compressive force at the aftward end of each batten 16' to force it toward the camber inducer 20' and thereby cause the batten 16' to bow to a desired degree.

The improvement according to the invention resides in the camber inducer 20' which comprises a coupling 24 having a yoke shaped portion 26 for pivotally seating against the mast 14. The coupling 24 includes a pair of spaced apart legs 28 extending away from the yoke shaped portion 26 and an end wall 30 which joins together the leg ends which are distal from the yoke shaped portion 26. The end wall 30 has an aperture 32 in it through which a batten end 34 can be inserted. A hollow batten fitting 36, which is rectangular in cross-section, has a batten end receiving recess 38 therein and is dimensioned relative to the aperture 32 such that the fitting 36 can pass through the aperture 32 to receive the batten end 34. The recess 38 extends over a substantial portion, e.g. three-fourths of the length of the batten fitting 36 to allow the batten end 34 to be fully seated therein.

As will be explained in greater detail further in this description, the fitting 36 slides under spring tension in the aperture 32 in the direction of the length of the batten 16' and can also pivot laterally in the aperture 32. In other, less advantageous embodiments, the forward batten end 34 can first pass through the aperture 32 and then enter the recess 38 of the batten fitting 36. In these embodiments, it is the batten end which bears against the edges of the aperture 32 during such lateral pivoting.

Means, in the form of a pair of tension springs 40, are provided along opposite edges of the fitting 36 for resiliently and pivotally attaching the batten fitting 36 to the pair of legs 28 via the end wall 30 such that the batten fitting 36 is positioned between the pair of legs 28. The springs 40 apply a resilient, tensile force between the batten fitting 36 and the end wall 30 such that when the batten restraining strap 17 applies an axial force to the aftward end of the batten 16, a substantially equal and opposite axial force is applied to the forward batten end 34 by the springs 40. Although the strap 17 is shown in FIG. 5 as being adjustable, in some embodiments, the strap is merely a nonadjustable portion of the sail which closes the aft end of the batten pocket 18. An axially compressive force is applied to the batten 17 due to the cut of the sail when the sail is pulled down tight (downhauled) on the mast 14, causing the mast 14 to bend, and the outhaul 19 is tightened.

Each spring 40 is pivotally attached at one end to opposite sides of the batten fitting 36, and the other end of each the spring 40 is attached to opposite edges of the end wall 30 alongside the aperture 32. The batten fitting 36 is rectangular in cross-section and is provided with a cross bore 42 through its end which is distal from the entrance to the recess 38. A shaft 44 is inserted in the cross bore 42. The length of the shaft 44 exceeds the length of the cross bore 42 so that the ends of the shaft 44 extend outwardly from the edges of the fitting 36 to provide a pair of spring attachment posts 46.

While in the preferred embodiment the springs 40 are a pair of tension springs, in other, equally advantageous embodiments, they could be straps of elastic material or, with proper mountings, compression springs. In fact, the batten fitting 36 could, itself, be made of an elastic material such as a marine grade rubber. In such an embodiment, the fitting 36 would be attached directly to the end wall 30.

Figure 7:
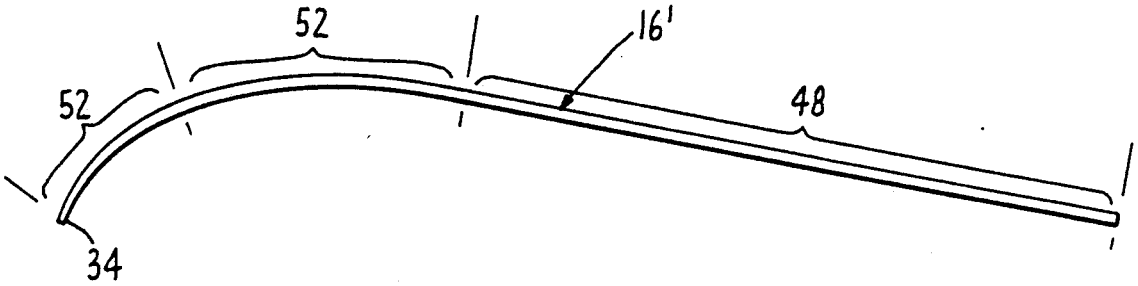
FIG. 7 is a plan view of a flexed batten for use with the camber inducer according to the invention.

Because of the springs 40, it is desirable that the sail batten 16' have a bending characteristic which varies along its length when the axial forces are applied by the restraining strap 17 and the springs 40 to the aftward and forward ends, respectively, of the batten. Therefore a novel batten 16', as shown in FIG. 7, for use with the above described camber inducer 20' preferably has a relatively stiff portion 48 at its aftward end, an intermediate portion 50 which allows a constant bend along the length of the intermediate portion 50, and a forward portion 52 which is tapered and which is progressively flexible from the intermediate portion to the forward batten end 34.

Referring now more particularly to FIGS. 5 and 6A to 6C the operation of the camber inducer 20' according to the present invention will now be described. As the batten strap 17 is tightened and the outhaul taken up to put tension on the sail 10 and to cause it to assume the foil form, the forward end 34 of the batten 16' along with the batten fitting 44 is pushed toward the leading edge of the sail 10 but is restrained by the counter force of the springs 40 acting between the posts 46 and the end wall 30. The force of the batten end 34 causes the springs 40 to distend, as shown in dashed line form in FIG. 6C. The batten 16' in the tensioned sail 10 pushes the springs approximately one-half way through the limit of their elastic travel.

Figure 6A:
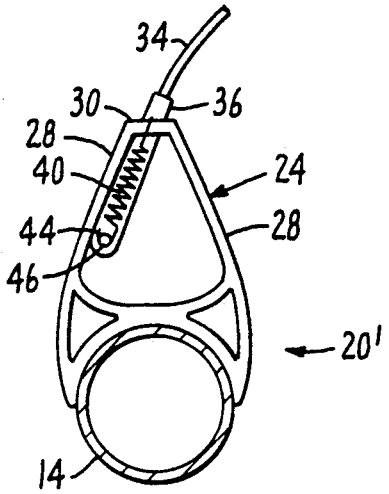
FIGS. 6A, 6B and 6C are diagrammatic plan views, similar to FIG. 5, showing lateral movement of the batten end as the sail is rotated on the mast and is loaded.
Figure 6C:
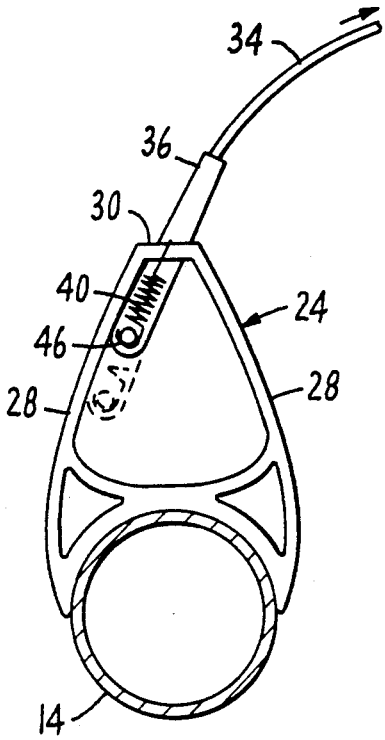

At this time, due to the foil shape adopted by the sail 10, the batten end 34 and the batten fitting 36 are pivoted against of the coupling legs 28, e.g. the left leg as viewed in FIGS. 5, 6A and 6C. When the sail 10 is rotated about the mast, for example when tacking, the forward batten end 34 pivots to abut the right leg 28 of the camber inducer 20', as viewed in FIG. 6B. The dashed path line in FIG. 5 shows the path travelled by the spring posts 46. Note that it is not a cylindrical arc. The springs 40 are extended as the camber inducer 24 pivots and then snap back to their half extended position at the new tack position. The springs 44 actually help push or "snap" the camber inducer 24 around to its new position once the half way point is reached, thus aiding in rotation of the sale about the mast during tacking.

The camber inducer 20' according to the present invention allows the force exerted on the batten 16' by the person rigging the sail to be stored in the springs 40 as they extend halfway through their elastic travel. During use, when the sail 10 is significantly loaded by wind forces, the energy stored in the springs 40 continuously forces the coupling 24 in an aerodynamically efficient position to resist detensioning and derotation of the leading edge of the sail 10. The springs 40 effectively allow the batten 16' to have a "variable" length in connecting to the camber inducer 20' so that even though wind loading may pull the forward batten ends 34 aft, the springs 40 still exert a force between the coupling 24 and the forward batten ends 34 to maintain fore and aft tension in the sail 10 and prevent derotation as well as maintain the desired foil shape.

Figure 6B:
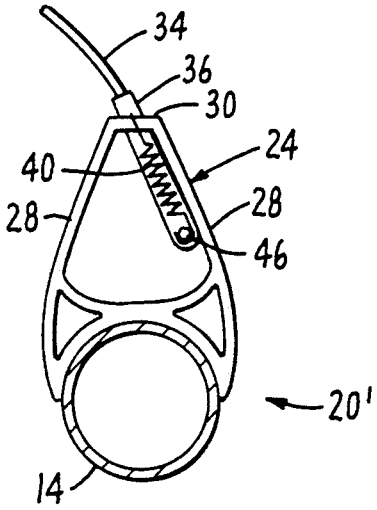

Also, the stiffer battens 16' inhibit the movement of the draft due to the fact that the battens 16' are not bending nearly as much as a conventional batten and can easily rotate about the mast from tack to tack because of the elasticity of the spring coupling which extends as the sail 10 is rotating and the batten end 34 is pivoting laterally with respect to the end wall 30 from the position shown in FIG. 6A to the position shown in FIG. 6B. In fact, the springs 40 actually help the forward batten end 34 complete its movement to the new position and then settle back into their mid travel position on the new tack. This process helps eliminate the common problem of breaking the forward batten end 34 as the sail 10 is rotated to the new tack position.

While the above-described camber inducer invention has been referred to in terms of a boardsailing sail, it is to be understood as having a broader application for use in ice boat sails, hang glider wings, or in any application where it is necessary to tension a fabric to force it to assume a rigid foil shape.

Although the present invention has been shown and described with respect to certain preferred embodiments, various changes and modifications which would be obvious to a person ordinarily skilled in the art to which the invention pertains are deemed to lie within the spirit and scope of the invention.

What is claimed is:

1. A camber inducer for a mast mounted sail having battens and which comprises:

(a) a coupling having a yoke shaped portion for pivotally seating against the mast, a pair of spaced apart legs extending away from the yoke shaped portion, and an end wall which joins together the leg ends which are distal from the yoke shaped portion, the end wall having an aperture therein through which access can be had to the forward end of a batten;

(b) a hollow batten fitting having a batten end receiving recess therein; and (c) means for resiliently and pivotally attaching the batten fitting to the pair of legs such that the batten fitting is positioned between the pair of legs with the batten fitting recess being oriented with respect to the end wall aperture so that the forward end of a batten can enter the recess and be received in the batten fitting and further including one or more elastic members connected between the batten fitting and the end wall which are capable of applying an aftward, springy force along the longitudinal axis of the batten.

2. A camber inducer as recited in claim 1 wherein the batten fitting pivots laterally within the end wall aperture.

3. A camber inducer for a mast mounted sail having battens and which comprises:

(a) a coupling having a yoke shaped portion for pivotally seating against the mast, a pair of spaced apart legs extending away from the yoke shaped portion, and an end wall which joins together the leg ends which are distal from the yoke shaped portion, the end wall having an aperture therein through which access can be had to the forward end of a batten;

(b) a hollow batten fitting having a batten end receiving recess therein; and (c) means for resiliently and pivotally attaching the batten fitting to the pair of legs such that the batten fitting is positioned between the pair of legs with the batten fitting recess being oriented with respect to the end wall aperture so that the forward end of a batten can enter the recess and be received in the batten fitting; and (d) wherein the resilient means comprises a pair of tension springs, each pivotally mounted at one end to a separate side of the batten fitting and at the other end to a separate, opposed edge of the end wall alongside the aperture.

4. A camber inducer as recited in claim 3 wherein the batten fitting is rectangular in cross-section and is provided with a pair of posts extending from each of its narrower sides and wherein the springs are pivotally attached at their one end to the separate posts.

5. An improved camber induced sail of the type which is mounted on a mast, has one or more battens for stiffening the sail to have a wing shape, and with respect to one or more of the battens, a separate camber inducer for each such batten for pivotally coupling it at one end to the mast, and a separate batten restraining strap for each such batten for applying an axially compressive force at the aftward end of the batten to force the batten toward the camber inducer and thereby cause the batten to bow to a desired degree, wherein the improvement is in the camber inducer which comprises:

a coupling having a yoke shaped portion for pivotally seating against the mast, a pair of spaced apart legs attached at one end to the yoke shaped portion and extending aft from it, and an end wall which joins together the leg ends which are distal from the yoke shaped portion, the end wall having an aperture therein through which the forward batten end can pass;

a hollow batten fitting having a recess therein into which the forward end of the batten is seated; and resilient means for resiliently and pivotally attaching the batten fitting to the pair of legs with the batten fitting being positioned between the pair of legs, the resilient means including one or more elastic members connected between the batten fitting and the end wall to apply an aftward, springy force along the longitudinal axis of the batten, such that when the batten restraining strap applies an axial force to the aftward end of the batten a substantially equal and opposite axial force is applied between the coupling and the forward end of the batten by the resilient means.

6. A camber inducer as recited in claim 5 wherein the resilient means comprises a pair of tension springs, each pivotally mounted at one end to a separate side of the batten fitting and at the other end to a separate, opposed edge of the end wall alongside of the aperture.

7. An improved camber induced sail as recited in claim 6 wherein the batten fitting is rectangular in cross-section and is provided with a pair of posts extending from each of its narrower sides and wherein the springs are pivotally attached at their one end to the separate posts.

8. A camber inducer as recited in claim 6 wherein the batten fitting extends part way through the end wall aperture and pivots laterally within it.

9. An improved camber induced sail as recited in claim 5 including a sail batten having a bending characteristic which varies along its length when the axial forces are applied by the restraining strap and the resilient means to the aftward and forward ends of the batten, respectively, the batten having a relatively stiff portion at its aftward end, an intermediate portion which allows a constant bend along the length of the intermediate portion, and a forward portion which is tapered and which is progressively flexible from the intermediate portion to the forward end of the batten.

10. An improved camber induced sail of the type which is mounted on a mast, has one or more battens for stiffening the sail to have a wing shape, and with respect to one or more of the battens, a separate camber inducer for each such batten for pivotally coupling it at one end to the mast, and a separate batten restraining strap for each such batten for applying an axially compressive force at the aftward end of the batten to force the batten toward the camber inducer and thereby cause the batten to bow to a desired degree, wherein the improvement is in the camber inducer which comprises:

a resilient coupling for pivotally connecting the forward end of a batten to the mast to allow the forward end of the batten to rotate about the mast while simultaneously applying an aftward force along the longitudinal axis of the batten and wherein each coupling comprises one or more tension springs connected between the coupling and the forward end of the batten.

11. An improved camber induced sail as recited in claim 10 wherein the coupling includes means for allowing the forward end of the batten to shift laterally with respect to the mast as the sail changes tack.

12. An improved camber induced sail as recited in claim 10 including a sail batten having a bending characteristic which varies along its length when the axial forces are applied by the restraining strap and the resilient means to the leeward and forward ends of the batten, respectively, the batten having a relatively stiff portion at its leeward end, an intermediate portion which allows a constant bend along the length of the intermediate portion, and a forward portion which is tapered and which is progressively flexible from the intermediate portion to the forward end of the batten.

* * * * *